US005251710A

United States Patent [19]

Laporte et al.

[11] Patent Number: 5,251,710

[45] Date of Patent: Oct. 12, 1993

[54] STABILIZED DRILL TUBE

[75] Inventors: Irwin J. Laporte; Amos J. Watkins, both of North Bay, Canada

[73] Assignee: JKS Boyles International Inc., Canada

[21] Appl. No.: 853,925

[22] Filed: Mar. 19, 1992

[30] Foreign Application Priority Data

Mar. 25, 1991 [CA] Canada ..... 2038378

[51] Int. Cl.[5] ..... E21B 17/10

[52] U.S. Cl. ..... 175/325.2

[58] Field of Search ..... 175/325.1, 325.2, 325.5

[56] References Cited

U.S. PATENT DOCUMENTS 3,250,578 5/1966 Lubbes ..... 175/325.2
4,708,203 11/1987 Walker ..... 175/325.2

FOREIGN PATENT DOCUMENTS 951717 7/1974 Canada .
966827 4/1975 Canada .
1016934 9/1977 Canada .
1037946 9/1978 Canada .
1044221 12/1978 Canada .
1164445 3/1984 Canada .
1189851 7/1985 Canada .
1253054 4/1989 Canada .

*Primary Examiner*—Terry Lee Melius
*Attorney, Agent, or Firm*—Leonard Bloom

[57] ABSTRACT

A stabilized drill string component includes an elongated tubular body. This body comprises a tubular stabilization section and at least one further tubular section. These tubular sections are integrally joined together in axially aligned relation. The stabilization section is much shorter than the further tubular section or sections but has a somewhat greater diameter than the latter such that the stabilization section can assist in stabilizing the drill string component during drilling by way of contact with the wall of the well bore. The wearing surfaces of the stabilization section are of substantially harder material than that of the further tubular section or sections thereby to provide substantial resistance to wear.

4 Claims, 2 Drawing Sheets

STABILIZED DRILL TUBE

BACKGROUND OF THE INVENTION

Excessive borehole deviation away from the planned plane in exploratory diamond drill holes is a costly problem for the exploration company. Targets are missed and in some cases re-drilling has to be carried out or wedging of the hole must be done to bring the inclination back on target or close to it. Wedging is also an expensive undertaking.

To minimize the deviation problem, numerous attempts have been made to stabilize the lower part of the drill string, namely, the core barrel and reaming shell. The latter is increased in length with an added diamond and carbide set sintered powder ring fused to the upper part of a blank to maximize flexing of the tool joint between the shell and outer tube. Next the outer tube is stabilized similarly to the shell by fusing three such rings at three foot spacings on the exterior of the outer tube. Similar rings are also employed on the locking coupling.

The other method is to use outer tube material similar in outside diameter to that of the carbide rings and to machine three angularly spaced flats approximately ½" wide full length on the exterior of the outer tube. The flats are for the purpose of allowing drilling fluid return from the coring bit. Both of these methods have their shortcomings.

The carbide ring concept requires that the reaming shell outer tube and locking coupling be handled with extreme care in terms of providing for non-contact with pipe wrenches, rod holders and chucks; otherwise the rings will crack and if this goes unnoticed the rings will come off in the drill hole while drilling with serious consequences. Even when using extreme care these rings are susceptible to damage from extreme thrust on the outer tube when penetrating hard rock formations. The outer tube tends to flex or bend, especially at the centre ring, which results in hair line cracks in the rings.

The use of the oversize stabilized outer tube with three angularly spaced flats machined full length on its surface is one alternative to the carbide ring type noted above. The fact that it provides minimal fluid passage area over it's full length (e.g. about 10 feet) is a drawback because the rate of penetration must be controlled to allow the drill bit cuttings to free flow past this lengthy flow restriction. This outer tube is also subject to premature wear since the material used in its make up is standard AISI-SAE 1035 material. Another problem that arises with this version is that the bore hole must be clear of cuttings, sand and cave-in material; otherwise this outer tube can become stuck in the hole because of the restricted overall tolerances.

SUMMARY OF THE INVENTION

One object of the invention is to provide a stabilized drill tube which has minimal potential in-hole problems other than normal wear and tear plus maximal stabilization with minimal deviation.

One of the major causes of wear, especially with restricted flow passage areas, is the presence of micron size bit cuttings mixed with the drilling fluid which is flushed from the bore hole at high velocity. This fluid suspension tends to wear any surface in the upward path of the suspension that has a protrusion of any kind, such as carbide rings or weldments.

Hence, another object of the present invention is to provide drill tube components that are heat treated and rounded in contour and which minimize wear because of their hard smooth surfaces enabling prolonged use with superior core barrel stabilization for a greater period of time.

A further object is to provide a stabilized drill tube providing improved directional stability of a drilling device as it penetrates the surrounding geological structure, while maintaining normal hydraulic characteristics, power requirements and penetration rates, (as experienced in non-controlled drilling) coupled with extended service life, mechanical dependability and flexibility of application.

Generally speaking, the invention provides a stabilized drill tube including a hardened steel stabilization section or sections fused in coaxial relation to steel drill stem sections, with connections which facilitate joining of the stabilized drill tube to other members of a drilling assembly such as a drill bit, reaming shell, adapter coupling, locking coupling, drive rod or combination thereof.

Thus, in accordance with an aspect of the invention is provided a stabilized drill string component which includes an elongated tubular body. This body comprises a tubular stabilization section and at least one further tubular section. These tubular sections are integrally joined together in axially aligned relation. The stabilization section is much shorter than the further tubular section or sections but has a somewhat greater diameter than the latter such that the stabilization section can assist in stabilizing the drill string component during drilling by way of contact with the wall of the well bore. The wearing surfaces of the stabilization section are of substantially harder material than that of the further tubular section or sections thereby to provide substantial resistance to wear.

In a further aspect of the invention the stabilization section has an exterior surface including circumferentially spaced axially extending flats separated by cylindrical portions.

Preferably, the stabilization section is joined to said at least one further tubular section by plasma-arc welds. In the preferred form of the invention, the drill string component includes upper and lower tubular sections which are disposed in flanking relation to the tubular stabilization section and integrally joined together in axially aligned relationship by means of the welds noted above.

Further in accordance with the invention, surfaces portions of the intermediate section, particularly the above-noted cylindrical portions between the flats, have a Rockwell C hardness which is typically in the order of 55 to about 65.

Further features of the invention will become apparent from the following description of a preferred embodiment of the invention, reference being had to the following drawings.

DESCRIPTION OF THE VIEW OF DRAWINGS

DETAILED DESCRIPTION OF THE PREFERRED EMBODIMENT

Figure 1:
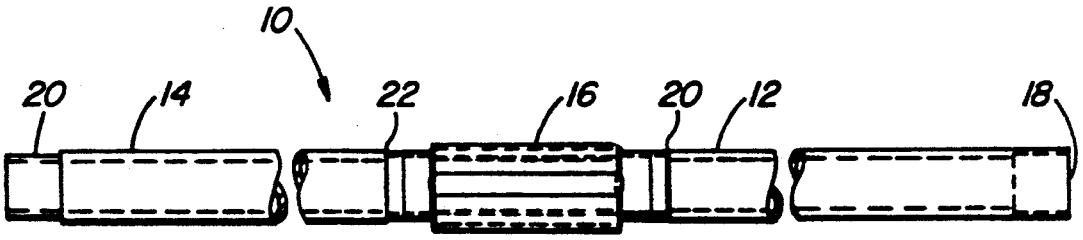
FIG. 1 is a side view of a stabilized drill tube in accordance with the invention, the drill tube being illustrated as broken in two places and greatly foreshortened in length to facilitate illustration.

Referring now to FIG. 1 there is shown a stabilized drill string component 10 in the form of an elongated tubular body. This tubular body includes upper 12 and lower 14 tubular sections disposed in flanking relation to an intermediate tubular stabilization section 16 and integrally joined together in axially aligned relation. The intermediate stabilization section 16 is many times shorter than either of the upper and lower tubular sections. At the same time the stabilization section has a somewhat greater diameter than these upper and lower sections 12 and 14. As a result, the intermediate stabilization section is capable of assisting in stabilizing the drill string component 10 during drilling by way of contact with the wall of the well bore. As described in further detail hereafter, this stabilization section 16 has surface portions of substantially harder material than that of the upper and lower sections thereby to provide increased resistance to wear. The stabilization section 16 is a unitary member in the sense that it is of one-piece construction, i.e. it is devoid of component parts such as hardened surface inserts and the like.

As illustrated in FIG. 1 the stabilized drill string component has an upper internally threaded box-end portion 18 and a lower externally threaded pin-end portion 20. The box and pin-ends 18 and 20 and the threads thereon may be of an entirely conventional nature and need not be described further.

The intermediate stabilization section 16 is joined to the upper and lower tubular sections 12 and 14 by plasma arc welds 20 and 22 respectively. Plasma arc welds are greatly preferred over more conventional welds for reasons which will become more apparent hereinafter.

Figure 2:
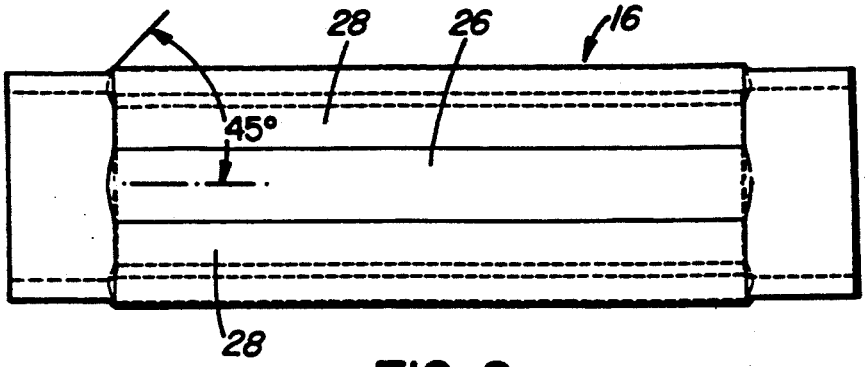
FIG. 2 is a side view of the intermediate stabilization section as it appears prior to being welded to the upper and lower drill tube sections.
Figure 3:
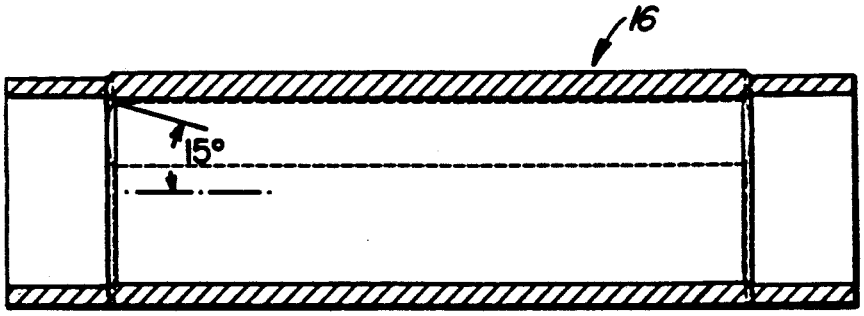
FIG. 3 is a longitudinal section of the stabilization section taken along section line 3—3 appearing in FIG. 4.
Figure 4:
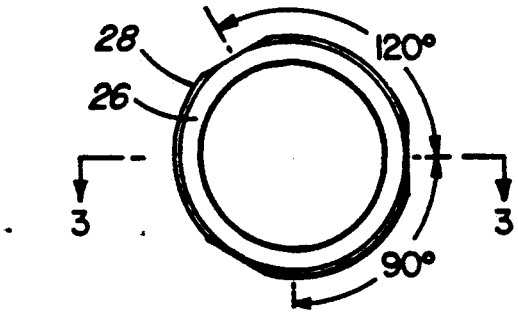
FIG. 4 is an end elevation view of the stabilization section of FIG. 2.
Figure 5:
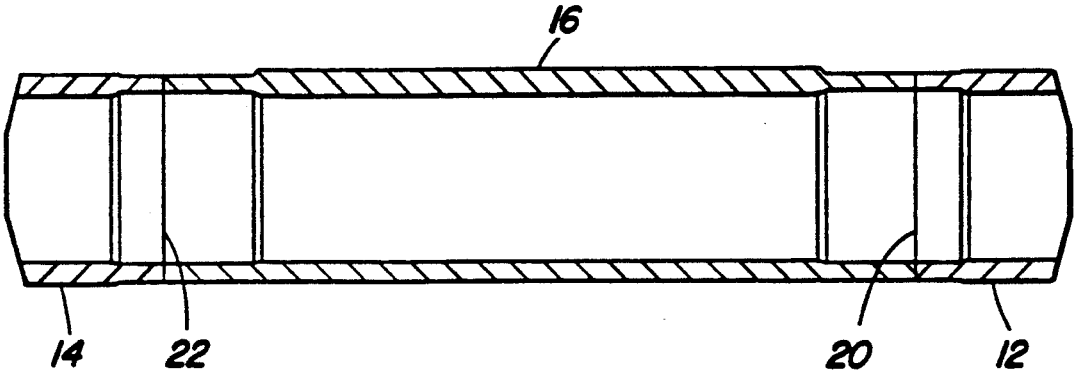
FIG. 5 is a longitudinal section view of the center stabilization section and adjoining end portions of the upper and lower drill tube sections after they have been welded to the opposing ends of the stabilization section.
Figure 6:
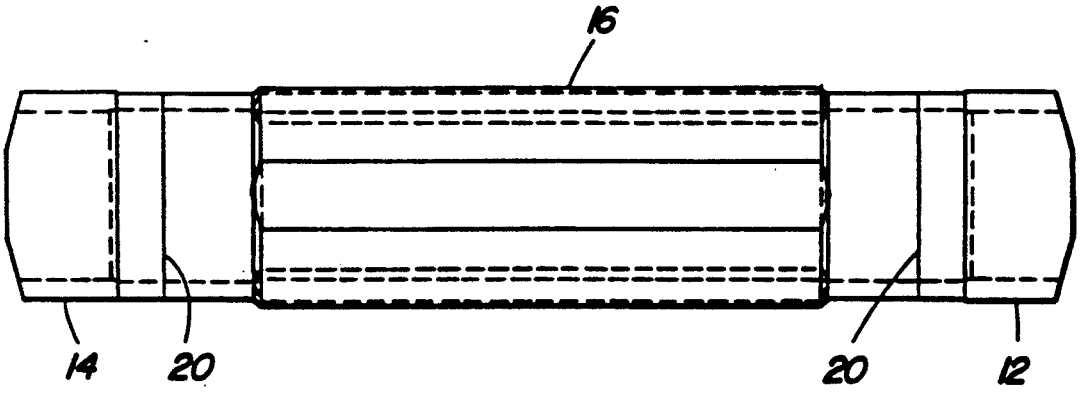
FIG. 6 is a side elevation view of the center stabilization section and adjoining ends of the upper and lower drill tube sections after they have been welded to opposing ends of the stabilization section.

The intermediate stabilization section 16 has a maximum outside diameter which is somewhat greater than the diameter of the upper and lower tubular sections 12, 14. In the embodiment illustrated in the drawings, the outside diameter of the stabilization section is nominally 2.35 inches while the upper and lower tubular sections have nominal outside diameters of 2.25 inches. Also, as illustrated in FIG. 4, the intermediate stabilization section 16 has three full length flats 26 ground thereon at 120° intervals. Typical dimensions are illustrated on the drawing especially FIGS. 2, 4 and 6.

Since the cylindrical surface portion 28 between the flats 26 are exposed to severe abrasion during use, it is important that they be adequately hardened. Typically, the cylindrical surface portions 28 have a Rockwell C hardness of about 55 to about 65, the hardness extending to a substantial depth as more fully described hereinafter.

In the preferred embodiments of the invention, the upper and lower tubular sections 12 and 14 are made of SAE 1035 steel while the intermediate stabilization section is of SAE 1045 steel.

For the information of those skilled in this art, the following detailed manufacturing procedure is presented for making not only the particular size illustrated in the drawings but a complete range of standard sizes A to P as well known in the diamond drilling industry.

The basic material as used in construction includes cold drawn seamless carbon steel tube containing a minimum carbon content of approximately 0.45% for induction surfaced hardened components, and minimum carbon content of approximately 0.354 for drill stem components. Minimum mechanical properties of 65,000 PSI. yield point, and 75,000 PSI ultimate tensile strength at an elongation of 8 percent are considered necessary.

Basic Machinery As Used in Manufacture

Band Saw—To cut individual component blanks.

Lathe—To prepare blanks for further process and finish up.

High Frequency Induction Unit—To provide surface induction hardening. The basic machine unit consists of a high frequency power source, (400 KHz) a mechanical scanner, a control console and a coolant supply recirculator.

Plasma Arc Welder—To join individual components of the stabilized drill tube. The basic machine unit consists of a D.C. power source, plasma and shield gas supply including metering control, plasma welding console, gas shielded plasma welding torch, coolant recirculator, special refitted engine lathe, i.e. (Feed shaft reduction and resolver controlled rotational drive for opposed saddle mounted air chucks) programmable control to coordinate action of these individual machine components.

Air Operated Hydraulic Tube Press—For selecting drill tube stem material, and maintaining product ie, (the stabilized drill tube) within straightness parameters, as specified.

Detailed Manufacturing Procedure

The appropriate drill tube stem material is selected by inspection, for initial straightness to a maximum allowable axial raisalignment specification of 0.032 inches, as indicated by radial measurement over any three foot long tube section.

All the appropriate raw materials for the manufacture of drill stem components; as well as those utilized in the manufacture of the intermediate drill tube stabilization sections are reduced to specific blank lengths in preparation for subsequent process. (length includes ⅛ inch for cleanup). Drill Tube Stem (minimum two req.)

| SIZES - A TO P | | | | |
|---|---|---|---|---|
| A. | 1 13/16" | O.D. | 1 7/16" | I.D. × 62⅛ inches long |
| B. | 2 1.4" | O.D. | 1 13/16" | I.D. × 62⅛ inches long |
| N. | 2⅞" | O.D. | 2⅜" | I.D. × 63⅛ inches long |
| H. | 3⅛" | O.D. | 3 1/16" | I.D. × 63⅛ inches long |
| P. | 4⅛" | O.D. | 4 1/16" | I.D. × 63⅛ inches long |

Intermediate Stabilization Section (min. one req.) (length includes ⅛ inch for clean up) (selected material diameter provides for removal of decarb zone)

| | | |
|---|---|---|
| A. 2" | O.D. 1 7/16" | I.D. × 7⅛ inches long |
| B. 2 7/16" | O.D. 1 13/16" | I.D. × 8¼ inches long |
| N. 3 1/16" | O.D. 2⅜" | I.D. × 9⅛ inches long |
| H. 3¾" | O.D. 3 1/16" | I.D. × 10⅛ inches long |
| P. 4 15/16" | O.D. 4 1/16" | I.D. × 10 13/16 inches long |

Machining of Drill Tube Stem Sections

These sections are end faced to a specified length of +0.031–+0.062 inch tolerance and surface finish of 63 R.M.S. Outside and inside diameters are relieved to a depth of 0.010–0.015 inches and length of 0.500 inches, in preparation for subsequent fusing to intermediate stabilization sections.

Machining of Intermediate Stabilization Sections

These sections are machined to specified dimensions, tolerance and surface finish of 125–63 R.M.S.

| |
|---|
| A. 1.880 O.D. + .003 − .000 × 7.500 inches long + .000 − .015 |
| B. 2.350 O.D. + .004 − .000 × 8.375 inches long + .000 − .015 |
| N. 2.970 O.D. + .005 − .000 × 9.000 inches long + .000 − .015 |
| H. 3.768 O.D. + .006 − .000 × 10.000 inches long + .000 − .015 |
| P. 4.810 O.D. + .007 − .000 × 10.688 inches long + .000 − .015 |

Further turning and boring of the stabilization sections is required to relieve the major and minor diameters at both ends to provide matching to their equivalent drill tube stem section counterparts. The relieved outside diameters are blended into the central portion major diameter at a 45 degree angle.

| |
|---|
| A. 1.792 O.D. + .003 − .000 × 0.750 inches + .015 |
| B. 2.230 O.D. + .004 − .000 × 1.000 inches + .015 |
| N. 2.850 O.D. + .005 − .000 × 1.250 inches + .015 |
| H. 3.595 O.D. + .006 − .000 × 1.500 inches + .015 |
| P. 4.595 O.D. + .007 − .000 × 1.750 inches + .015 |

The process further requires milling a pattern of three full length flats as noted previously, on the major diameter parallel to the axis at 120 degree intervals around the circumference to a maximum depth equal to 0.5 of the calculated difference of outside major and relieved diameters.

The intermediate stabilization sections 16 are now ready for subsequent induction surface hardening and the further process of fusing to the prepared tubular drill stem sections.

Induction Surface Hardening

The intermediate stabilization sections are mounted between centres of the mechanical scanning device, which will provide controlled part rotation, in conjunction with travel of the appropriate selected inductor and quench ring.

The control console is adjusted to provide the appropriate rate of scanning and related part rotation, electrical power, coolant and quench supply as dictated by finished part requirements. These specifications are case depth and hardness specifications of Rockwell C60+-5, to a rainimum depth equal to the calculated radial distance, from a point on the major diameter, to a central point on the flat milled surface.

SHIELDED PLASMA-ARC WELDING

The fusing of the stabilized drill tube components e.g. tubular components 12, 14 and 16 to form a totally integrated unit, comprises:

1) Cleaning, degreasing, and deburring of the mating surfaces in the usual fashion in preparation of surfaces to be welded.

2) Programming of the computer control to provide coordinated sequence application of the individual machine units in accordance with welding parameters as dictated by finished part requirements.

3) Placement of individual drill tube components, i.e. (butting of the relieved ends in axial alignment of one drill tube section and one intermediate stabilization section) by utilization of one air chuck mounted on lathe spindle nose) and two opposed air chucks specially fitted on lathe saddle.

4) The two components are then fused together by way of the well known shielded plasma arc welding process.

5) A second drill tube section is fused to the opposite end of the intermediate stabilization section in a like manner, thus forming a totally integrated drill tube blank, with a centrally located induction surface hardened stabilization section.

Checking and Straightening

The completed drill tube blank is placed in a tube press to be checked for axial alignment over its entire length. The specifications of maximum allowable misalignment is a radially indicated measurement of 0.015 inches over any three foot long section of the drill tube blank. Blanks that do not conform to specification are rotated into a position which allows pressure to be applied to high points. The tube is flexed in the direction of low points to bring it within specification.

Finish Machining Procedure

The required thread connections are now machined on the extreme ends of the blank to specifications which conform to the prior art, as it applies to the parameters, of a core barrels particular design i.e. (dimensions, tolerance, thread form, contour, surface finish,, and application), thereby to complete the pin and box ends of the stabilized drill tube component. The final product is interchangeable with standard core barrel parts as utilized by the diamond drilling industry. The final product can be applied individually or in combination within a core barrel assembly of like design.

We claim:

1. A stabilized drill string component comprising an elongated tubular body, said body comprising upper and lower tubular sections disposed in flanking relation to an intermediate tubular stabilization section and integrally joined together in axially aligned relation, the intermediate stabilization section being several times shorter than either of the upper and lower sections, and said intermediate stabilization section being of unitary construction and having exterior surface portions which are substantially harder than the material of the upper and lower sections thereby to provide increased resistance to wear, said exterior surface portions comprising circumferentially spaced cylindrical portions separated by axially extending flats, said cylindrical portions being substantially larger in a circumferential direction than said flats, said cylindrical portions having greater diameter than the upper and lower sections whereby the intermediate stabilization section assists in stabilizing the drill string component during drilling through contact of said cylindrical portions with the wall of the well bore.

2. The drill string component of claim 1 wherein said intermediate stabilization section is joined to the upper and lower sections by plasma arc welds.

3. The drill string component of claim 1, wherein said cylindrical surface portions of said intermediate stabilization section have a Rockwell C hardness of about 55 to about 65.

4. The drill string component of claim 1, wherein said upper and lower sections are each of SAE 1035 steel and said intermediate stabilization section is of SAE 1045 steel, said cylindrical surface portions of the latter between said flats having a Rockwell C surface hardness of about 55 to about 65.

* * * * *